US009787003B2

(12) United States Patent
Kamoshida et al.

(10) Patent No.: US 9,787,003 B2
(45) Date of Patent: Oct. 10, 2017

(54) CRIMP TERMINAL AND ELECTRIC WIRE WITH CRIMP TERMINAL

(71) Applicant: NISSHIN STEEL CO., LTD., Tokyo (JP)

(72) Inventors: Shinichi Kamoshida, Osaka (JP); Tadaaki Miono, Osaka (JP); Yasunori Hattori, Osaka (JP); Takeshi Shimizu, Osaka (JP); Mitsuru Suzuki, Tokyo (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 0 days.

(21) Appl. No.: 14/909,897

(22) PCT Filed: Aug. 8, 2013

(86) PCT No.: PCT/JP2013/071489
§ 371 (c)(1),
(2) Date: Feb. 3, 2016

(87) PCT Pub. No.: WO2015/019462
PCT Pub. Date: Feb. 12, 2015

(65) Prior Publication Data

US 2016/0172769 A1 Jun. 16, 2016

(30) Foreign Application Priority Data

Aug. 6, 2013 (JP) ..... 2013-163171

(51) Int. Cl.
*H01R 4/18* (2006.01)
*H01R 4/62* (2006.01)

(52) U.S. Cl.
CPC ..... *H01R 4/188* (2013.01); *H01R 4/183* (2013.01); *H01R 4/185* (2013.01); *H01R 4/62* (2013.01)

(58) Field of Classification Search
CPC ..... H01R 4/18; H01R 4/183; H01R 4/184; H01R 4/185; H01R 4/188
See application file for complete search history.

(56) References Cited

U.S. PATENT DOCUMENTS 5,302,146 A * 4/1994 Yamamoto ..... H01R 4/185 439/865
8,221,171 B2 * 7/2012 Ono ..... H01R 4/185 439/877
2002/0119700 A1 * 8/2002 Murakami ..... H01R 4/185 439/606

FOREIGN PATENT DOCUMENTS

CN 201214433 Y 4/2009
CN 103155287 A 6/2013
(Continued)

OTHER PUBLICATIONS

Notice of Acceptance mailed Mar. 16, 2016 in corresponding Australian Patent Application No. 2013397426 (2 pages).
(Continued)

*Primary Examiner* — Ross Gushi
(74) *Attorney, Agent, or Firm* — Rothwell, Figg, Ernst & Manbeck, P.C.

(57) ABSTRACT

A crimp terminal includes an F-type crimp portion and a C-type crimp portion. The F-type crimp portion has first and second barrel tabs, preferably with an identical length, for crimping a tip end of a complex stranded wire. The F-type crimp portion is adapted to have distal ends of the first and second barrel tabs put together and pushed into the tip end of the complex stranded wire to be crimped. The C-type crimp portion has a third barrel tab for crimping the complex stranded wire. The third barrel tab is wound in a C-form on an outer periphery of the complex stranded wire to be crimped. The arrangement provides a crimp terminal and an electric wire with crimp terminal, that prevents or reduces
(Continued)

increases in retained resistance at a crimp portion, and can also prevent an electric wire from slipping out of a crimp terminal.

11 Claims, 16 Drawing Sheets

(56) References Cited

FOREIGN PATENT DOCUMENTS

| | | | |
|---|---|---|---|
| EP | 1 035 616 | A1 | 9/2000 |
| GB | 2 363 525 | A | 12/2001 |
| JP | 51-7512 | Y1 | 2/1976 |
| JP | 59-165390 | | 9/1984 |
| JP | 5-190214 | A | 7/1993 |
| JP | 2003-7361 | A | 1/2003 |
| JP | 2003-249284 | A | 9/2003 |
| JP | 2005-50736 | | 2/2005 |
| JP | 2006-339040 | A | 12/2006 |
| JP | 2008-226671 | | 9/2008 |
| JP | 2009-152162 | A | 7/2009 |
| JP | 2009-289558 | A | 12/2009 |
| JP | 2010-50051 | | 3/2010 |
| JP | 2010-73320 | A | 4/2010 |
| JP | 2010-140808 | A | 6/2010 |
| JP | 2010-198776 | A | 9/2010 |
| JP | 2010-244888 | A | 10/2010 |
| KR | 10-2000-0076735 | A | 12/2000 |
| KR | 10-2011-0010565 | A | 2/2011 |

OTHER PUBLICATIONS

Notice of Allowance mailed Mar. 3, 2016 in corresponding Canadian Patent Application No. 2,919,809 (1 page).

International Search Report mailed Sep. 10, 2013 in PCT/JP2013/071489.

Substantive Examination Report mailed May 19, 2016 in corresponding Philippines Application No. 1/2016/500179 (2 pages).

European search report mailed May 8, 2017 in corresponding EP Patent Application No. 13891117.7 (9 pages).

* cited by examiner

CRIMP TERMINAL AND ELECTRIC WIRE WITH CRIMP TERMINAL

CROSS REFERENCE TO RELATED APPLICATION

This application is a 35 U.S.C. 371 National Phase Entry Application from PCT/JP2013/071489, filed Aug. 8, 2013, which claims priority to Japanese Patent Application No. 2013-163171, filed Aug. 6, 2013, the disclosures of which are incorporated herein in their entirety by reference.

TECHNICAL FIELD

This invention relates to a crimp terminal of an open barrel type adapted to fix, by crimping, an electric wire having a complex stranded wire including a set of conductor element wires wound on an outer periphery of a reinforcement wire, and to an electric wire with crimp terminal employing a crimp terminal for crimping such an electric wire.

TECHNICAL FIELD

There are aluminum electric wires each made of aluminum or an aluminum alloy. When compared with copper wires, they have smaller strengths, and when given small wire diameters, they tend to be cut. For this reason, as disclosed in the patent literature 1, there have been developed complex stranded wires each including a combination of a reinforcement wire having a greater strength than aluminum wires, and aluminum element wires.

In situations involving an electric wire having a complex stranded wire, to be crimped by using a crimp terminal of an open barrel type, there can be use of a crimp terminal including an F-type crimp portion, as disclosed in the patent literature 2.

However, in a situation involving, as shown in FIG. 26, a complex stranded wire having a set of aluminum element wires 42 wound on an outer periphery of a reinforcement wire 41, as it is crimped by an F-type crimp portion 43, the F-type crimp portion 43 has barrel tabs taking bites into the complex stranded wire, constituting a difficulty to place the reinforcement wire 41 at the center. Hence, there might be uneven forces acting on the set of aluminum element wires 42, involving concentrated forces acting on some aluminum element wires 42, giving reduced sectional areas to the aluminum element wires 42. Accordingly, there might be aluminum element wires 42 having decreased strengths at the F-type crimp portion 43.

Further, there are situations involving an aluminum electric wire to be crimped, including, as disclosed in the patent literature 3, employing a crimp terminal having a C-type crimp portion. In addition, at the C-type crimp portion, there is no need to have barrel tabs taking bites into the aluminum electric wire. As a result, in situations involving the C-type crimp portion, as it is employed to crimp a complex stranded wire having a set of aluminum element wires wound on an outer periphery of a reinforcement wire, there can be an even crimping made to the set of aluminum element wires, thus allowing for the set of aluminum element wires to be kept from having decreased strengths at the C-type crimp portion.

CITATION LIST

Patent Literatures

Patent literature 1: JP 2006-339040 A
Patent literature 2: JP H5-190214 A
Patent literature 3: JP 2010-73320 A

SUMMARY OF INVENTION

Problems to be Solved by the Invention

However, in situations involving a C-type crimp portion employed to crimp a complex stranded wire having a set of aluminum element wires wound on an outer periphery of a reinforcement wire, there might be a combination of a state of the C-type crimp portion enfolding in a manner of enwrapping a longer one of barrel tabs from one side of the complex stranded wire and a state at a terminal end of the complex stranded wire having disarrayed aluminum element wires, so when enfolding the complex stranded wire with the barrel tabs being two, the two barrel tabs might have aluminum element wires escaping out of an opening defined between distal end parts thereof. As a result, there might be aluminum element wires protruding out of the opening of the C-type crimp portion. In this case, the C-type crimp portion is to have a reduced packing ratio of aluminum element wires therein, constituting a cause to have an increased resistance at the C-type crimp portion.

It is noted that, as a countermeasure to this issue, there might have been a C-type crimp portion including barrel tabs wrapped in a direction for aluminum element wires to have an increased twist. In this case, however, there would have been aluminum element wires subjected to a limited twist direction, as a problem. Further, there might have been a set of aluminum element wires firmly fixed together by way of an ultrasonic bond or such, subject to an increased cost in production of wire in combination with a decreased flexibility of wire, as a problem.

Moreover, among situations involving a C-type crimp portion employed to crimp a complex stranded wire having a set of aluminum element wires wound on an outer periphery of a reinforcement wire, there can be situations due to that the reinforcement wire has a greater strength than the aluminum element wires, involving a state of the reinforcement wire little deformed at the C-type crimp portion, thus accompanied by a state of the reinforcement wire insufficiently fixed to the C-type crimp portion. Accordingly, when undergoing tensile forces acting on the electric wire, there might be tensile forces mainly acting on the aluminum element wires. On the other hand, in the situations involving the C-type crimp portion employed to crimp the complex stranded wire, there can be a non-deformed state of the reinforcement wire located at the center, affording simply for the aluminum element wires at the outside to be deformed. Therefore, when the complex stranded wire and the aluminum electric wire are crimped by the C-type crimp portion with comparable crimping forces, there can be sectional areas at the aluminum element wires of the complex stranded wire more reduced than a sectional area of the aluminum electric wire. In addition, the aluminum element wires have smaller strengths than the reinforcement wire. Accordingly, in situations involving tensile forces acting on the electric wire, there might be aluminum element wires broken at the C-type crimp portion, followed by the reinforcement wire being slid relative aluminum element wires, and followed by the electric wire being slipped out of the crimp terminal.

This invention has been made to solve the problems described. It therefore is an object thereof to provide a crimp terminal and an electric wire with crimp terminal, allowing for a retained resistance not to be increased at a crimp portion, as well as an electric wire to be kept from slipping out of a crimp terminal.

Solutions to Solve the Objective

According to a first aspect of this invention, there is a crimp terminal of an open barrel type adapted to fix, by crimping, an electric wire including a complex stranded wire involving a set of conductor element wires wound on an outer periphery of a reinforcement wire, the reinforcement wire having a strength greater than strengths of the conductor element wires, the crimp terminal comprising an F-type crimp portion comprising a first and a second barrel tab, the first and the second barrel tab being disposed at opposite locations, with a longitudinal centerline of the complex stranded wire to be crimped in between, the first and the second barrel tab having an identical length, the F-type crimp portion being configured to have distal ends of the first and the second barrel tab put together to push into a tip end of the complex stranded wire to be crimped, and a C-type crimp portion comprising a third barrel tab adapted to crimp the complex stranded wire, the C-type crimp portion being configured to have the third barrel tab wrapped in a C-form on an outer periphery of the complex stranded wire to be crimped.

Further, according to a second aspect of this invention, the F-type crimp portion may well comprise a convex provided at a part thereof for the complex stranded wire to be brought into contact therewith, the convex having a height thereof set to be equal to or greater than one sixth of a diameter of the complex stranded wire.

Further, according to a third aspect of this invention, the crimp terminal may well comprise convexes including the convex, the convexes having a spacing therebetween in a longitudinal direction of the complex stranded wire, set to be equal to or greater than the diameter of the complex stranded wire.

Further, according to a fourth aspect of this invention, the first and the second barrel tab may well have protruding parts provided thereon, the protruding parts having a protrusion length set to be equal to or greater than one third of the diameter of the complex stranded wire.

Further, according to a fifth aspect of this invention, there is an electric wire with crimp terminal adapted for use of a crimp terminal to fix, by crimping, an electric wire including a complex stranded wire involving a set of conductor element wires wound on an outer periphery of a reinforcement wire, the reinforcement wire having a strength greater than strengths of the conductor element wires, wherein the crimp terminal comprises an F-type crimp portion and a C-type crimp portion, the F-type crimp portion comprises a first and a second barrel tab, the first and the second barrel tab being disposed at opposite locations, with the complex stranded wire in between, the first and the second barrel tab having an identical length, the first and the second barrel tab having distal ends thereof put together and pushed into the complex stranded wire, to crimp a tip end of the complex stranded wire, and the C-type crimp portion comprises a third barrel tab, the third barrel tab being wrapped in a C-form on an outer periphery of the complex stranded wire, to crimp the complex stranded wire.

Further, according to a sixth aspect of this invention, the reinforcement wire may well comprise a steel wire aluminum-plated on the outer periphery, and the conductor element wires comprise aluminum element wires.

Effects of the Invention

According to the first and the fifth aspect, the complex stranded wire can be crimped at a tip end thereof by the F-type crimp portion. At the F-type crimp portion, the first and the second barrel tab have an identical length, so the complex stranded wire is to be enwrapped simultaneously from both right and left sides. Therefore, even if the complex stranded wire had conductor element wires disarrayed at the tip end thereof, the conductor element wires would be kept from protruding out of an opening of the F-type crimp portion. Further, at the F-type crimp portion, since the first and the second barrel tab are forced to press the complex stranded wire from above, as well, to take bites into the complex stranded wire, the conductor element wires are kept from escaping upward, as well. As a result, even if the complex stranded wire had conductor element wires disarrayed at the tip end thereof, those conductor element wires residing at the tip end of the complex stranded wire could be put within the F-type crimp portion. Accordingly, the conductor element wires are kept from protruding out of the opening at the C-type crimp portion. For the reasons described, the packing ratio of conductor element wires in the C-type crimp portion is kept from decreasing, so the resistance at the C-type crimp portion is kept from increasing.

Further, since the complex stranded wire can be crimped at the tip end by the F-type crimp portion, the reinforcement wire at the tip end of the complex stranded wire can be deformed at the F-type crimp portion, affording for a tip end of the reinforcement wire to be sufficiently fixed to the F-type crimp portion. Therefore, at the C-type crimp portion, there is no need to fix the reinforcement wire, thus allowing for decreased crimping forces smaller than at C-type crimp portions in the past. In addition, when the electric wire undergoes tensile forces acting thereon, the reinforcement wire also has tensile forces acting thereon, thus affording to decrease tensile forces acting on the conductor element wires at the C-type crimp portion. Therefore, even if conductor element wires had their sectional areas decreased by a crimping at the C-type crimp portion, the conductor element wires would be kept from being cut at the C-type crimp portion, thus allowing for a state of the electric wire kept free from slipping out of the crimp terminal.

In addition, at the C-type crimp portion, there can be a set of conductor element wires crimped evenly, affording to evenly deform the conductor element wires. It therefore is possible to prevent the conductor element wires from having decreased strengths at the C-type crimp portion. Moreover, since the reinforcement wire can be located centrally, the reinforcement wire can be kept free from contacting the C-type crimp portion. Therefore, the complex stranded wire and the C-type crimp portion can be kept from undergoing increased conduction resistances in between. For the reasons described, this crimp portion is kept from experiencing increased resistances, and the electric wire is kept from slipping out of the crimp terminal.

Further, according to the second aspect, the F-type crimp portion has a convex provided at a local part thereof for the complex stranded wire to be brought into contact therewith. The convex has a height thereof set to be equal to or greater than one sixth of a diameter of the complex stranded wire. Accordingly, the reinforcement wire can have an increased amount of deformation at the F-type crimp portion, allowing for a state of the reinforcement wire strongly fixed to the F-type crimp portion.

Further, according to the third aspect, the crimp terminal has convexes including the above-noted convex, and the convexes have a spacing therebetween in a longitudinal direction of the complex stranded wire, the spacing being set to be equal to or greater than the diameter of the complex stranded wire. Accordingly, the reinforcement wire can have an ensured increase amount of deformation at the F-type crimp portion, allowing for an ensured state of the reinforcement wire fixed to the F-type crimp portion.

Further, according to the fourth aspect, the first and the second barrel tab have protruding parts provided thereon, the protruding parts having a protrusion length set to be equal to or greater than one third of the diameter of the complex stranded wire. Accordingly, the reinforcement wire can have an increase amount of deformation at the F-type crimp portion, allowing for a state of the reinforcement wire fixed to the F-type crimp portion.

Further, according to the sixth aspect, the reinforcement wire is a steel wire, and the conductor element wires are aluminum element wires, so the electric wire is made without using copper, and the electric wire costs low. Further, the steel wire is aluminum-plated on the outer periphery, so the steel wire has suppressed corrosion with the aluminum element wires.

EMBODIMENTS FOR CARRYING OUT THE INVENTION

Figure 1:
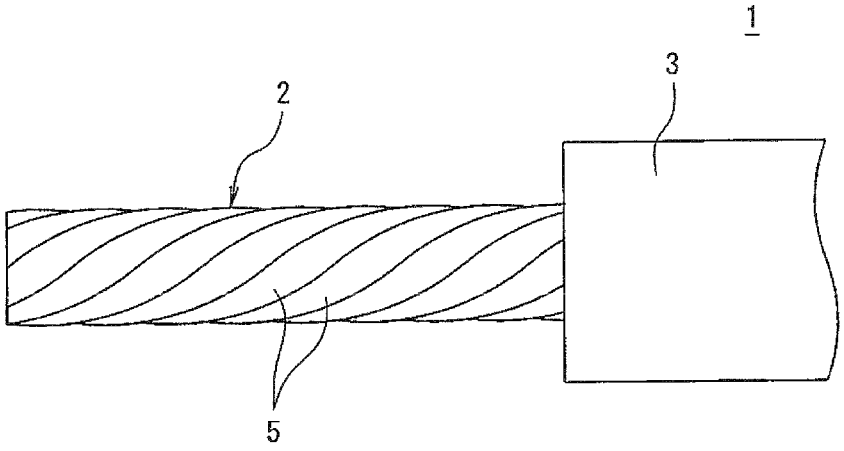
FIG. 1 is a front view showing an end portion of an electric wire to be crimped by a crimp terminal according to an embodiment of this invention.

There will be described an electric wire to be crimped by a crimp terminal according to an embodiment of this invention, with reference to FIG. 1 and FIG. 2. There is an electric wire 1 including a complex stranded wire 2, and a coating 3. The complex stranded wire 2 has a steel wire 4 being a single reinforcement wire, and a set of aluminum element wires 5 being six conductor element wires. The steel wire 4 has an aluminum-plated outer periphery. The aluminum element wires 5 are spirally wound on an outer periphery of the steel wire 4. The aluminum element wires 5 are made of aluminum or of an aluminum alloy, for instance, an A1070 make. The steel wire 4 and a respective aluminum element wire 5 have an identical diameter being 0.2 mm, and the complex stranded wire 2 has a diameter of 0.6 mm. The coating 3 is made of, for instance, a vinyl chloride, and the coating 3 has a thickness of, for instance, 0.3 mm.

Description is now made of a crimp terminal according to an embodiment of this invention, with reference to FIGS. 3 to 8. As shown in the figures, there is a crimp terminal 11 including a connecting portion 12, an F-type crimp portion 13, a C-type crimp portion 14, a coating crimp portion 15, and a carrier stop 16. The C-type crimp portion 14 is adjacent to the coating crimp portion 15. And, the crimp terminal 11 is produced by press forging a tin-plated brass sheet 0.3 mm thick, for instance.

Figure 4:
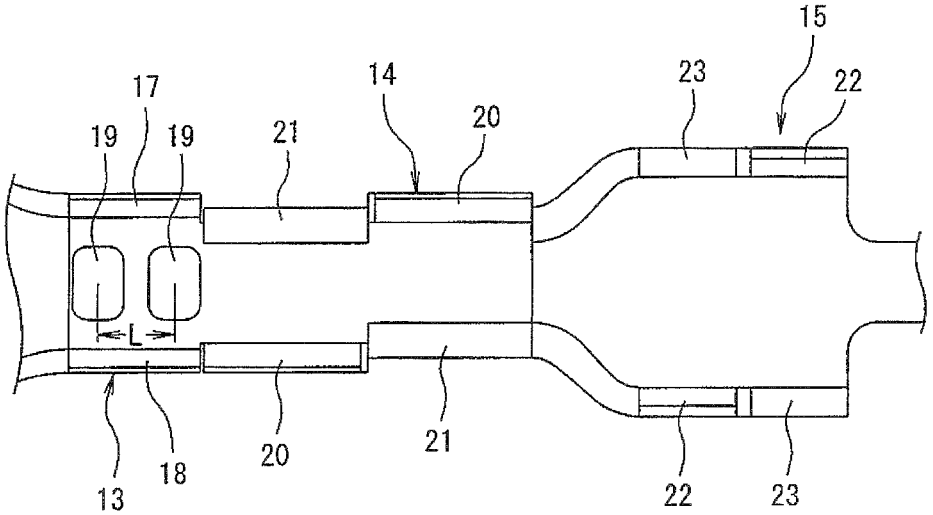
FIG. 4 is a plan view, detailed in part, of the crimp terminal shown in FIG. 3.
Figure 5:
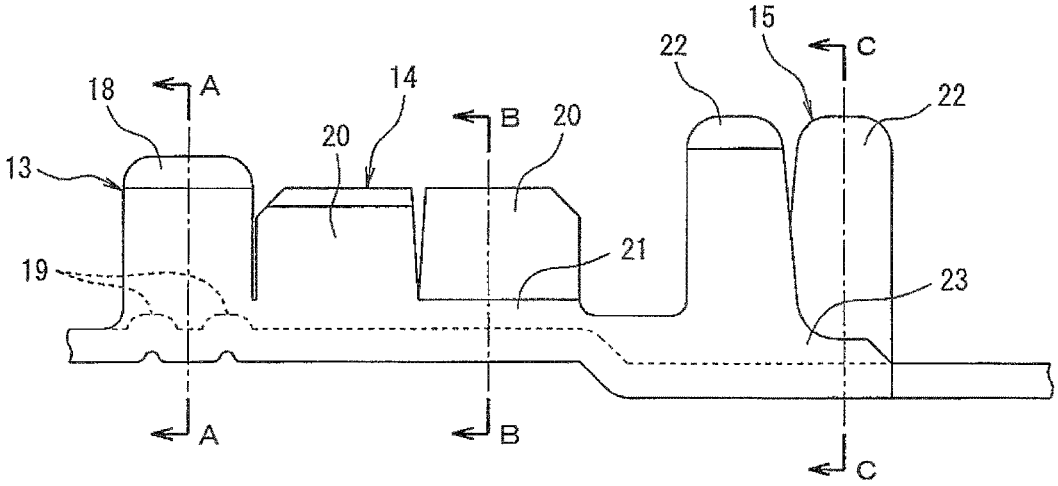
FIG. 5 is front view, detailed in part, of the crimp terminal shown in FIG. 3
Figure 6:
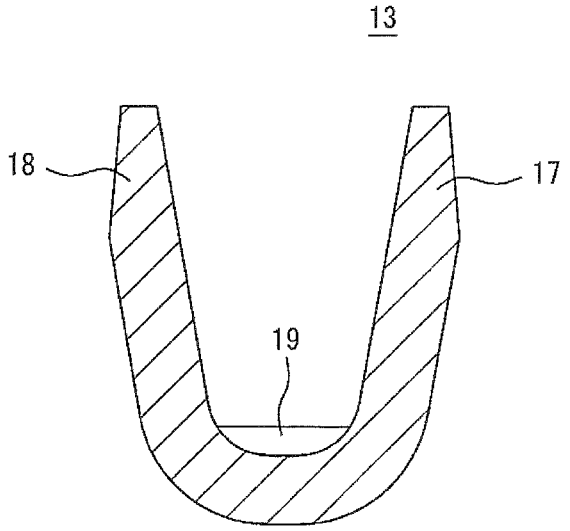
FIG. 6 is an enlarged A-A section of FIG. 5.
Figure 7:
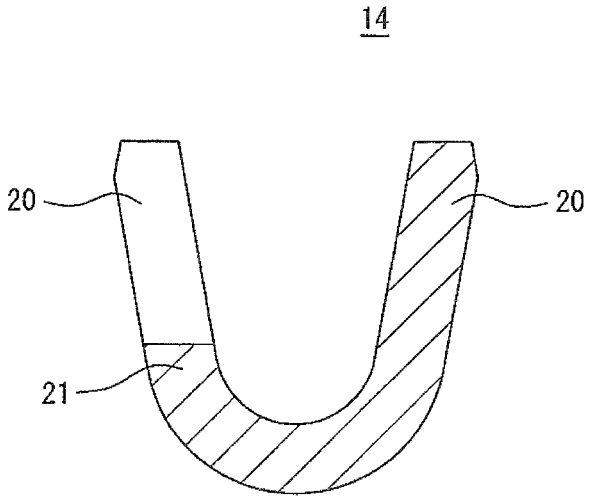
FIG. 7 is an enlarged B-B section of FIG. 5.
Figure 8:
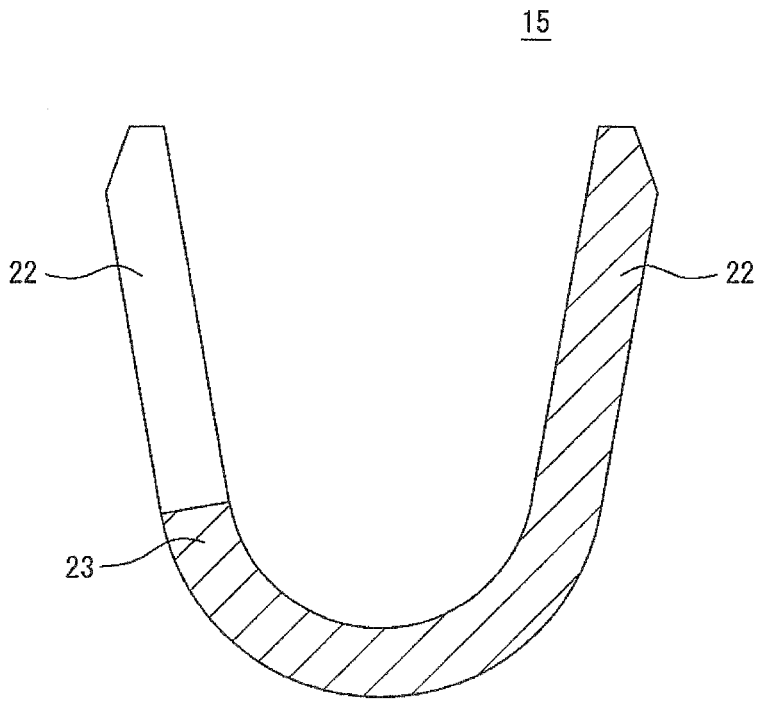
FIG. 8 is an enlarged C-C section of FIG. 5.

The F-type crimp portion 13 has a first and a second barrel tab 17 and 18 for crimping a tip end of a complex stranded wire 2. The first and the second barrel tab 17 and 18 are disposed at opposite locations, with a longitudinal centerline of the complex stranded wire 2 to be crimped in between. The first and second barrel tabs 17 and 18 have an identical length. At the F-type crimp portion 13, the first and second barrel tabs 17 and 18 have their distal ends put together to push into a tip end of the complex stranded wire 2. Further, the F-type crimp portion 13 may well have two convexes 19 at local parts thereof for the complex stranded wire 2 to be brought into contact therewith. In FIG. 4, the convexes 19 are arrayed in a longitudinal direction of the crimp terminal 11, that is, in a left to right direction on the sheet of paper. The convexes 19 have a height of 0.1 mm. Further, the convexes 19 have a center-to-center distance of 0.7 mm, that is, a distance L between the convexes 19 in a longitudinal direction of the complex stranded wire 2.

The C-type crimp portion 14 has two sets of third and fourth barrels 20 and 21 for crimping the complex stranded wire 2. There third and fourth barrel tabs 20 and 21 are disposed at opposite positions, with a longitudinal centerline of the complex stranded wire 2 to be crimped in between. The third barrel tabs 20 are longer than the fourth barrel tabs 21. The C-type crimp portion 14 is adapted to make a crimp, by winding the third barrel tabs 20 on outer peripheral sections of the complex stranded wire 2 in C-forms. The two sets of third and fourth barrel tabs 20 and 21 are wound on the outer peripheries of the complex stranded wire 2, in different directions.

The coating crimp portion 15 has two sets of fifth and sixth barrel tabs 22 and 23 for crimping a coating 3 of an electric wire 1. The fifth and sixth barrel tabs 22 and 23 are disposed at opposite positions, with a longitudinal centerline of the electric wire 1 to be crimped in between. The fifth barrel tabs 22 are longer than the sixth barrel tabs 23. The coating crimp portion 15 is adapted to make a crimp, by winding the fifth barrel tabs 22 on outer peripheral sections of the coating 3 in C-forms. The two sets of fifth and sixth barrel tabs 22 and 23 are wound on the outer peripheries of the coating 3, in different directions.

Description is now made of an electric wire with crimp terminal according to an embodiment of this invention, with reference to FIGS. 9 to 12. It is noted that the crimp terminal 11 shown in FIGS. 3 to 8 is employed to provide as a crimp terminal, and an electric wire 1 is crimped by the crimp terminal 11 by using a crimping machine.

Figure 9:
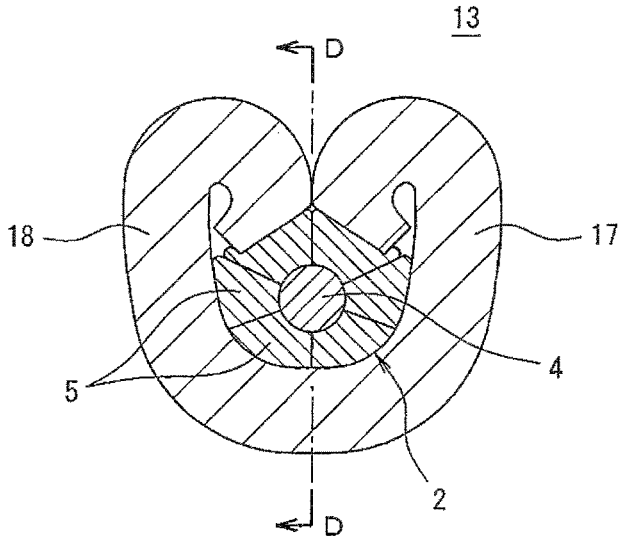
FIG. 9 is a sectional view showing an F-type crimp portion of an electric wire with crimp terminal according to an embodiment of this invention being an electric wire with crimp terminal employing the crimp terminal shown in FIG. 5.
Figure 10:
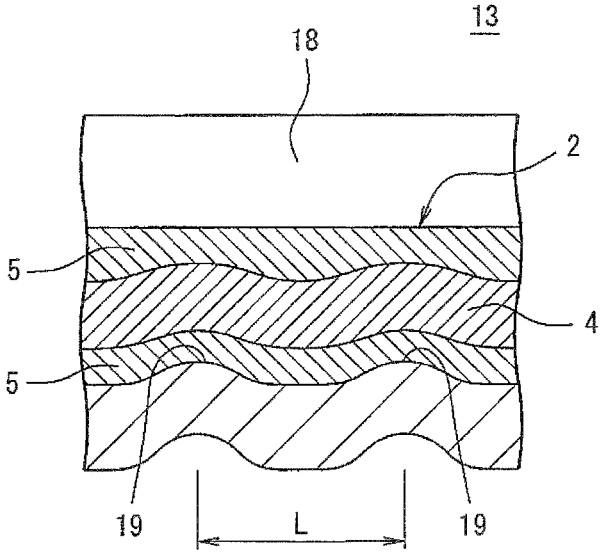
FIG. 10 is a D-D section of FIG. 9.

As shown in FIG. 9, there is an F-type crimp portion 13 having a first and a second barrel tab 17 and 18 disposed at opposite locations, with a complex stranded wire 2 in between. At the F-type crimp portion 13, the first and the second barrel tab 17 and 18 have their distal ends put together to push into a tip end of the complex stranded wire 2. And, at the F-type crimp portion 13, the complex stranded wire 2 has a sectional area decreasing ratio, for instance, of 35%. In other words, after a crimping, the complex stranded wire 2 has a sectional area decreased, for instance, by 35% from a sectional area of the complex stranded wire 2 before the crimping. Further, at the F-type crimp portion 13, a steel wire 4 has a sectional area decreasing ratio, for instance, of 28%. Further, as shown in FIG. 10, the steel wire 4 is flexed by convexes 19.

Figure 11:
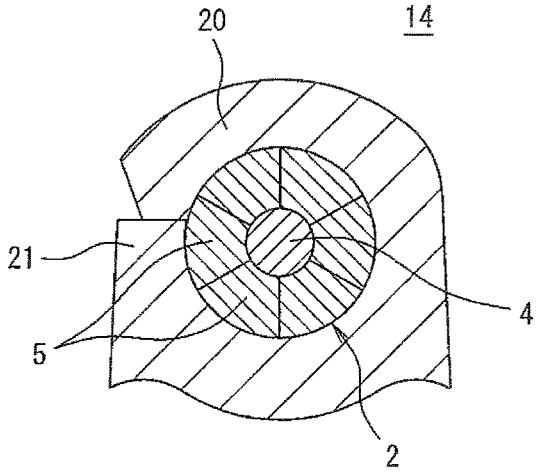
FIG. 11 is a sectional view showing a C-type crimp portion of an electric wire with crimp terminal according to an embodiment of this invention.

Further, as shown in FIG. 11, there is a C-type crimp portion 14 having two sets of third and fourth barrel tabs 20 and 21 disposed at opposite positions, with the complex stranded wire 2 in between. At the C-type crimp portion 14, the third barrel tabs 20 are wound on outer peripheral sections of the complex stranded wire 2 in C-forms. The two sets of third and fourth barrel tabs 20 and 21 are wound on the outer peripheries of the complex stranded wire 2, in different directions. And, at the C-type crimp portion 14, the complex stranded wire 2 has a sectional area decreasing ratio, for instance, of 25%. In other words, after a crimping, the complex stranded wire 2 has a sectional area decreased, for instance, by 25% from a sectional area of the complex stranded wire 2 before the crimping. Further, at the C-type crimp portion 14, the steel wire 4 has a sectional area decreasing ratio, for instance, of 10%.

Figure 12:
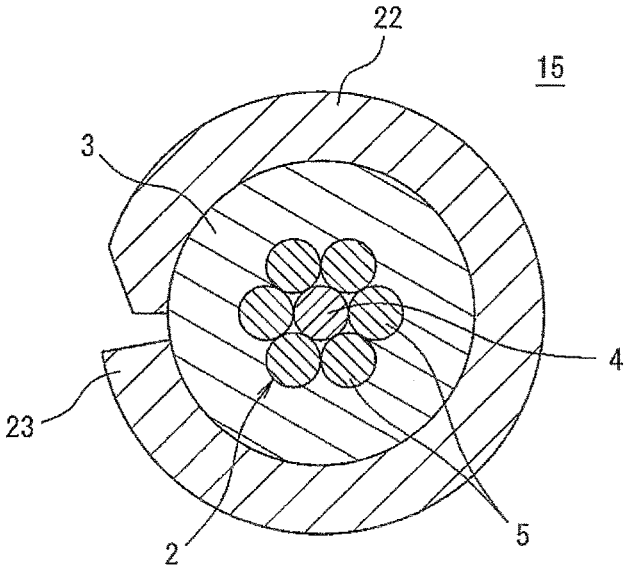
FIG. 12 is a sectional view showing a coated crimp portion of an electric wire with crimp terminal according to an embodiment of this invention.

Further, as shown in FIG. 12, there is a coating crimp portion 15 having two sets of fifth and sixth barrel tabs 22 and 23 disposed at opposite positions, with a coating 3 in between. At the coating crimp portion 15, the fifth barrel tabs 22 are wound on outer peripheral sections of the coating 3 in C-forms. The two sets of fifth and sixth barrel tabs 22 and 23 are wound on the outer peripheries of the coating 3, in different directions.

According to embodiments herein, the crimp terminal, as well as the electric wire with crimp terminal, is adapted to employ the F-type crimp portion 13 for crimping a tip end of the complex stranded wire 2. At the F-type crimp portion 13, the first and the second barrel tab 17 and 18 have an identical length, so the complex stranded wire 2 is to be enwrapped simultaneously from both right and left sides. Therefore, even if the complex stranded wire 2 had aluminum element wires 5 disarrayed at the tip end thereof, the aluminum element wires 5 would be kept from protruding out of an opening of the F-type crimp portion 13. Further, at the F-type crimp portion 13, since the first and the second barrel tab 17 and 18 are forced to press the complex stranded wire 2 from above as well to take bites into the complex stranded wire 2, the aluminum element wires 5 are kept from escaping upward, as well. As a result, even if the complex stranded wire 2 had aluminum element wires 5 disarrayed at the tip end thereof, those aluminum element wires 5 residing at the tip end of the complex stranded wire 2 could be put within the F-type crimp portion 13. Accordingly, the aluminum element wires 5 are kept from protruding out of the opening at the C-type crimp portion 14. Therefore, the packing ratio of aluminum element wires 5 in the C-type crimp portion 14 is kept from decreasing, so the resistance at the C-type crimp portion 14 is kept from increasing.

Further, the F-type crimp portion 13 is adapted to crimp the tip end of the complex stranded wire 2, and at the F-type crimp portion 13, the first and the second barrel tab 17 and 18 have their distal ends put together and pressed into the tip end of the complex stranded wire 2. Hence, at the tip end of the complex stranded wire 2, the steel wire 4 can be deformed in the F-type crimp portion 13, thus affording for a tip end of the steel wire 4 to be sufficiently fixed to the F-type crimp portion 13. Therefore, at the C-type crimp portion 14, there is no need to fix the steel wire 4, thus allowing for decreased crimping forces smaller than at C-type crimp portions in the past. In addition, when the electric wire 1 undergoes tensile forces acting thereon, the steel wire 4 also has tensile forces acting thereon, thus affording to decrease tensile forces acting on the aluminum element wires 5 at the C-type crimp portion 14. Therefore, even if aluminum element wires 5 had their sectional areas decreased by a crimping at the C-type crimp portion 14, the aluminum element wires 5 would be kept from being cut at the C-type crimp portion 14, thus allowing for a state of the electric wire 1 kept free from slipping out of the crimp terminal.

Further, at the C-type crimp portion 14, there can be a set of aluminum element wires 5 crimped evenly, affording to evenly deform the aluminum element wires 5. It therefore is possible to prevent the aluminum element wires 5 from having decreased strengths at the C-type crimp portion 14. Moreover, since the steel wire 4 can be located centrally, the steel wire 4 can be kept free from contacting the C-type crimp portion 14. Therefore, the complex stranded wire 2 and the C-type crimp portion 14 can be kept from undergoing increased contact resistances in between. For the reasons described, the C-type crimp portion 14 is kept from experiencing increased resistances, and the electric wire 1 is kept from slipping out of the crimp terminal 11.

Further, the F-type crimp portion 13 has convexes 19 provided at local parts thereof for the complex stranded wire 2 to be brought into contact therewith. The convexes 19 have a height thereof set to 0.1 mm, as it is equal to or greater than one sixth of a diameter of the complex stranded wire 2, and simultaneously equal to or greater than one half of a diameter of the steel wire 4. Accordingly, the steel wire 4 can have an increased amount of deformation at the F-type crimp portion 13, allowing for a state of the steel wire 4 strongly fixed to the F-type crimp portion 13.

Further, the convexes 19 provided as a set of convexes are spaced from each other by a spacing L set to 0.7 mm, as it is equal to or greater than the diameter of the complex stranded wire 2, and simultaneously equal to or greater than the diameter of the steel wire 4 times 3. Accordingly, the steel wire 4 can have an ensured increase amount of deformation at the F-type crimp portion 13, allowing for an ensured state of the steel wire 4 fixed to the F-type crimp portion 13.

Further, the electric wire 1 is a combination of the steel wire 4 as a reinforcement wire and the aluminum element wires 5 as a set of conductor element wires, so the electric wire 1 is made without using copper, and the electric wire 1 costs low. Further, the steel wire 4 is aluminum-plated over the outer periphery, so the steel wire 4 has suppressed corrosion with the aluminum element wires 5.

Figure 13:
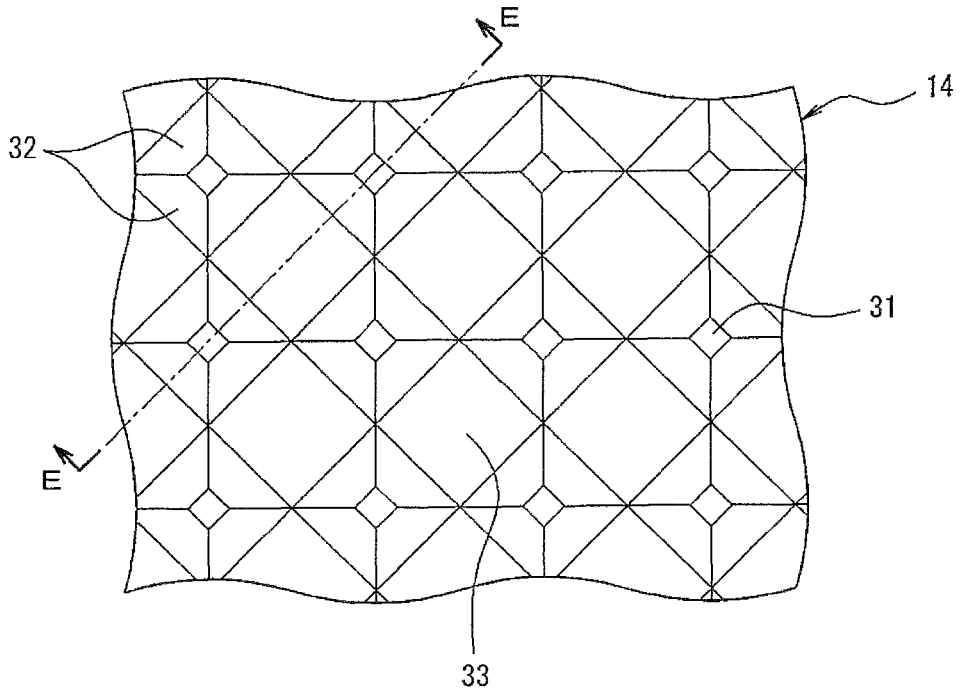
FIG. 13 is a diagram showing part of a crimp terminal according to another embodiment of this invention.
Figure 14:
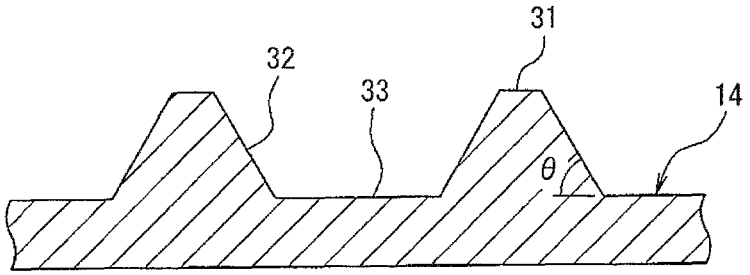
FIG. 14 is an E-E section of FIG. 13.

Description is now made of a crimp terminal according to another embodiment of this invention, with reference to FIGS. 13 and 14. As shown in the figures, there is a set of projections 31 provided at a surface of a C-type crimp portion 14 contacting with a complex stranded wire 2. The projections 31 are formed in a truncated quadrangular pyramid shape, the projections 31 each having a set of four triangular inclined sides 32. The C-type crimp portion 14 has a set of areas 33 of the surface each surrounded by four projections 31, and involved inclined sides 32 each have an inclination angle θ within a range 45 to 75 degrees relative thereto.

Figure 15:
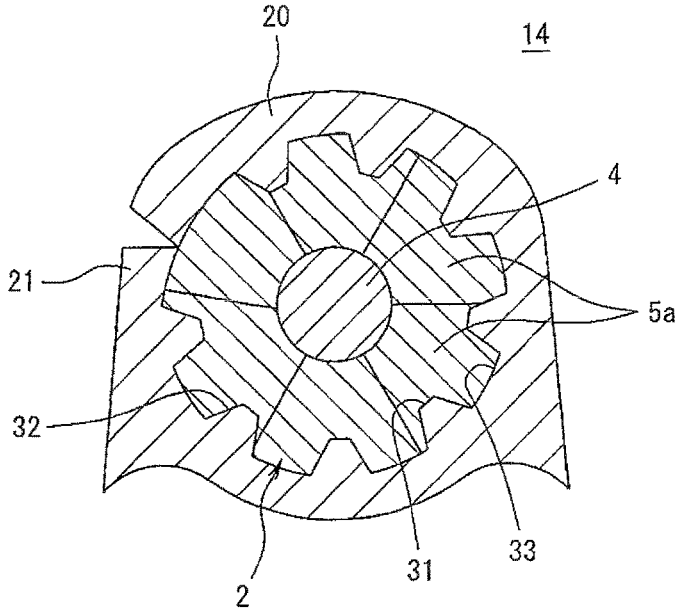
FIG. 15 is a sectional view showing part of an electric wire with crimp terminal employing the crimp terminal shown in FIG. 13.
Figure 16:
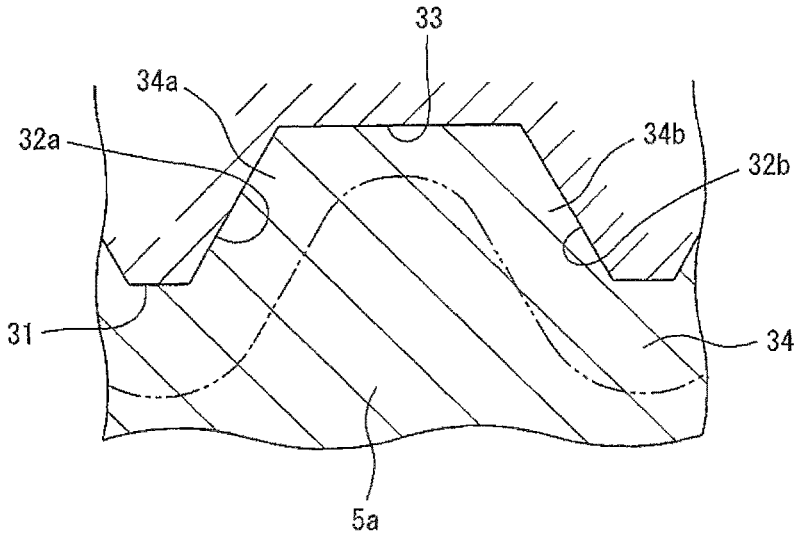
FIG. 16 is a fragmentary detail view of FIG. 15.

Description is now made of an electric wire with crimp terminal according to another embodiment of this invention, with reference to FIGS. 15 and 16. As shown in the figures, there is a C-type crimp portion 14 provided with a set of projections 31 projected into areas of surface of a set of deformed aluminum element wires 5*a*, as they are deformed when crimped. For this reason, at the deformed aluminum element wires 5*a*, the surface areas have a set of distorted regions 34 produced therein as illustrated by two-dot chain lines. And, as will be seen from FIG. 13, at each surface area 33, the four projections 31 enclosing that 33 each have an inclined side 32 thereof opposing another inclined side 32. Therefore, as shown in FIG. 16, the distorted regions 34 each have a combination of a local region 34*a* thereof extending along an inclined side 32*a* and a local region 34*b* thereof extending along an inclined side 32*b*, opposing each other. Accordingly, there can be cold flows developed from one local region 34*a* of the distorted region 34 and stopped by another local region 34*b* of the distorted region 34, thus allowing for an ensured stop of cold flow. As a result, at the distorted regions 34, depressions of stresses due to cold flows can be suppressed, thus allowing for suppressed depressions of crimping forces (adhesive forces) between the set of deformed aluminum element wires 5*a* and respective inclined sides 32 of the set of projections 31. Accordingly, between the complex stranded wire 2 and the C-type crimp portion 14, there can be suppressed increases in electric resistances.

Figure 17:
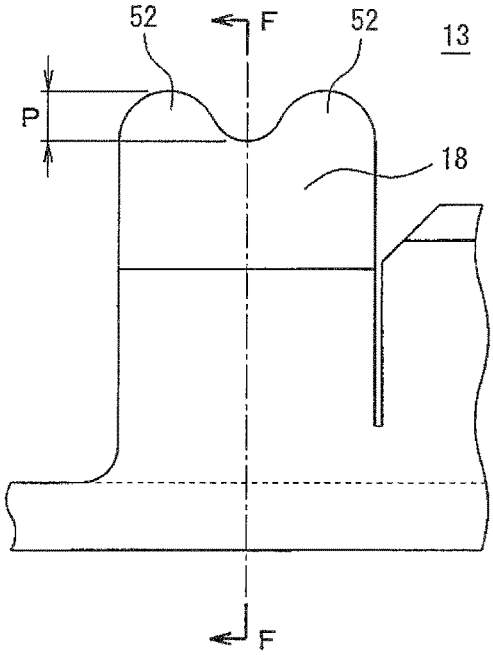
FIG. 17 is a diagram showing an F-type crimp portion of a crimp terminal according to another embodiment of this invention.
Figure 18:
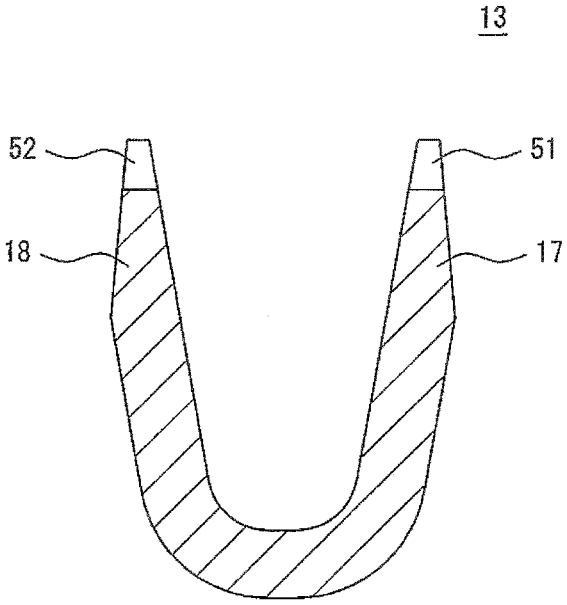
FIG. 18 is an F-F section of FIG. 17.

Description is now made of a crimp terminal according to another embodiment of this invention, with reference to FIGS. 17 and 18. As shown in the figures, there is an F-type crimp portion 13 including a first and a second barrel tab 17 and 18 provided with pairs of protruding parts 51 and 52, respectively. The protruding parts 51 and 52 have a protrusion length P of 0.3 mm, as it is equal to or greater than one third of a diameter of a complex stranded wire 2. This F-type crimp portion 13 has no convex, while elements else of its configuration are similar to those of configuration of the crimp terminal shown in FIG. 3.

The crimp terminal above, as well as an electric wire with crimp terminal employing that crimp terminal, has a combination of the protruding parts 51 and 52 pushed into a tip end of the complex stranded wire 2, affording for the tip end of the complex stranded wire 2 to have a steel wire 4 thereof deformed at the F-type crimp portion 13, thus allowing for a tip end of the steel wire 4 to be sufficiently fixed to the F-type crimp portion 13.

Figure 19:
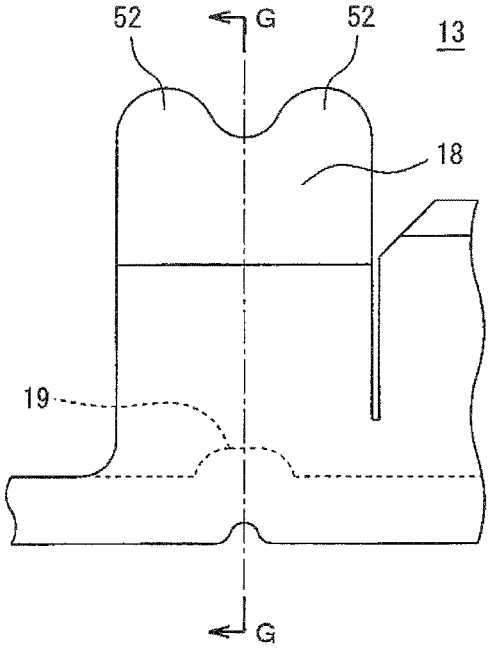
FIG. 19 is a diagram showing an F-type crimp portion of a crimp terminal according to another embodiment of this invention.
Figure 20:
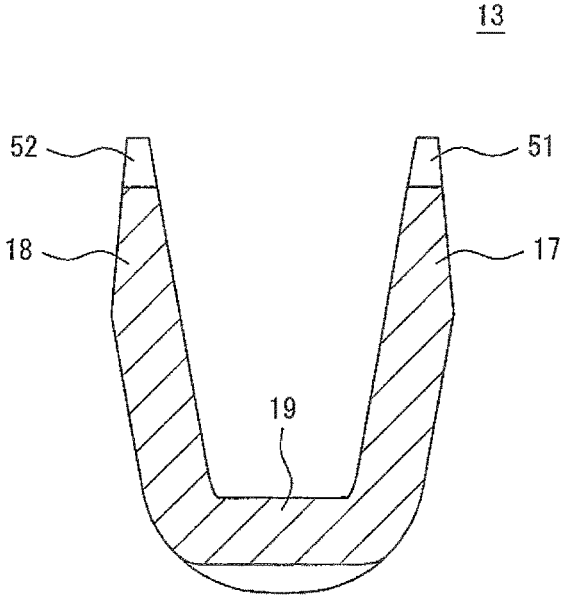
FIG. 20 is a G-G section of FIG. 19.

Description is now made of a crimp terminal according to another embodiment of this invention, with reference to FIGS. 19 and 20. As shown in the figures, there is an F-type crimp portion 13 including a first and a second barrel tab 17 and 18 provided with pairs of protruding parts 51 and 52, respectively. The protruding parts 51 and 52 have a protrusion length P of 0.3 mm. Further, the F-type crimp portion 13 has a single convex 19 provided at a central part in a longitudinal direction of a complex stranded wire 2. Elements else of the configuration are similar to those of configuration of the crimp terminal shown in FIG. 3.

The crimp terminal above, as well as an electric wire with crimp terminal employing that crimp terminal, has a combination of the protruding portions 51 and 52 adapted to push local regions at both sides of the convex 19 on a steel wire 4 at a tip end of the complex stranded wire 2. Therefore, the steel wire 4 at the tip end of the complex stranded wire 2 can be deformed in a large way at the F-type crimp portion 13, thus allowing for a tip end of the steel wire 4 to be sufficiently fixed to the F-type crimp portion 13.

Figure 21:
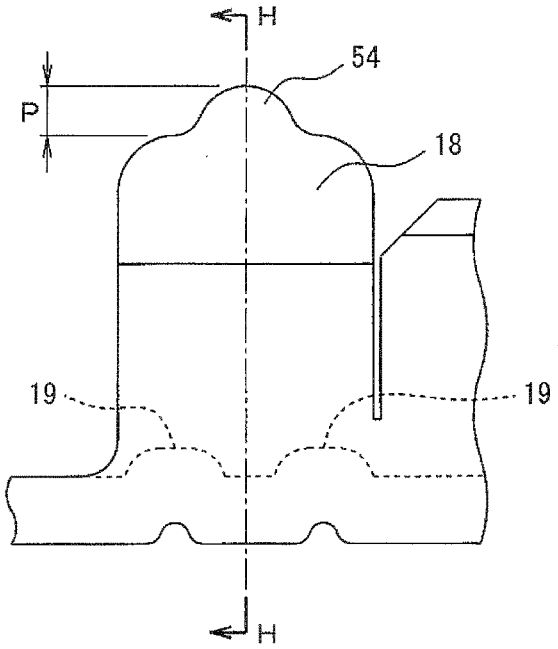
FIG. 21 is a diagram showing an F-type crimp portion of a crimp terminal according to another embodiment of this invention.
Figure 22:
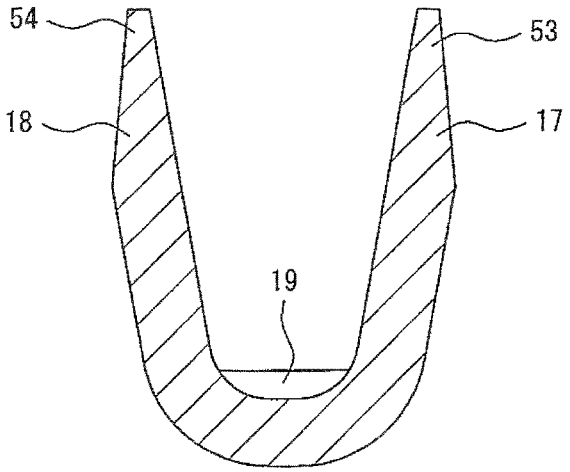
FIG. 22 is a H-H section of FIG. 19.

Description is now made of a crimp terminal according to another embodiment of this invention, with reference to FIGS. 21 and 22. As shown in the figures, there is an F-type crimp portion 13 including a first and a second barrel tab 17 and 18 provided with protruding parts 53 and 54, at a central part in a longitudinal direction of a complex stranded wire 2. Like the before-mentioned protruding parts 51 and 52, the protruding parts 51 and 52 have a protrusion length P of 0.3 mm, as it is equal to or greater than one third of a diameter of the complex stranded wire 2. Elements else of the configuration are similar to those of configuration of the crimp terminal shown in FIG. 3.

Figure 23:
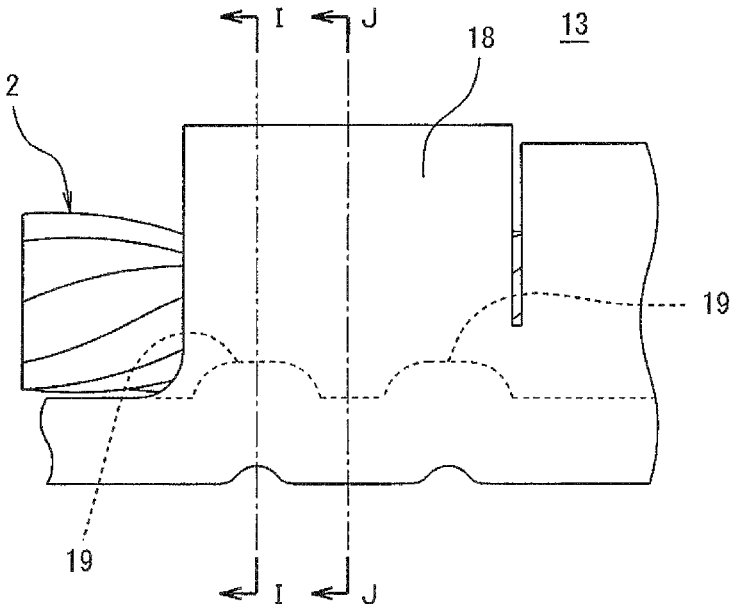
FIG. 23 is a diagram showing an F-type crimp portion of an electric wire with crimp terminal according to another embodiment of this invention.
Figure 24:
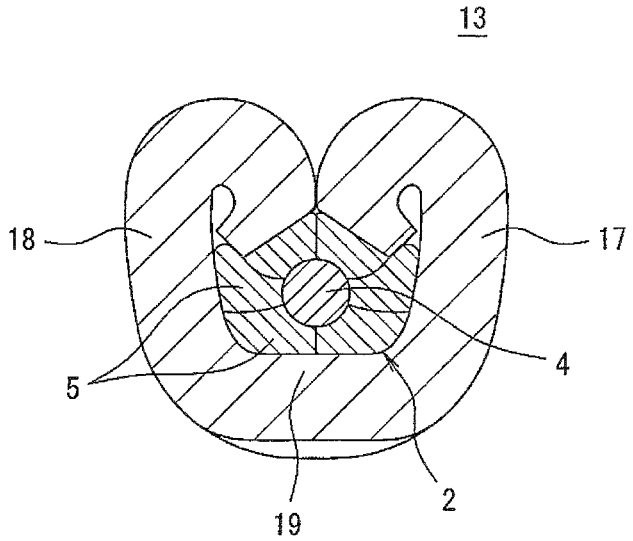
FIG. 24 is an I-I section of FIG. 23.
Figure 25:
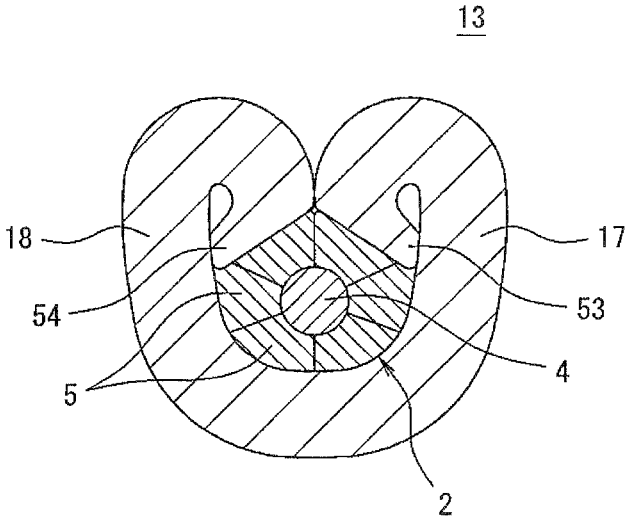
FIG. 25 is an J-J section of FIG. 23.
Figure 26:
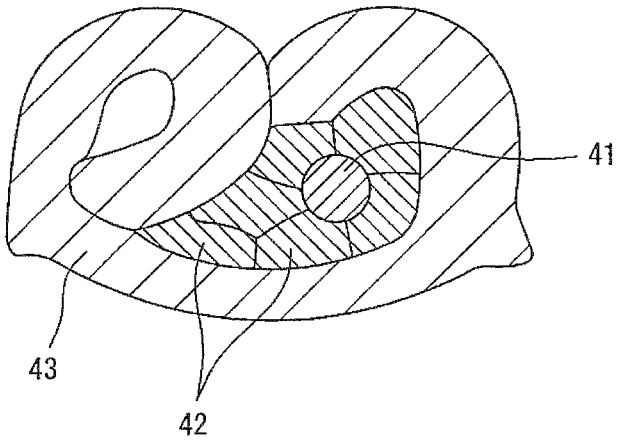
FIG. 26 is a sectional view showing part of an electric wire with crimp terminal in the past.

Description is now made of an electric wire with crimp terminal according to another embodiment of this invention, with reference to FIGS. 23 to 25. There is an electric wire 1 crimped by employing the crimp terminal shown in FIGS. 21 and 22. And, there is a set of aluminum element wires 5 pushed inwardly by protruding parts 53 and 54. Further, the aluminum element wires 5 are pushed inwardly by convexes 19.

The crimp terminal shown in FIGS. 21 and 22, as well as the electric wire with crimp terminal shown in FIGS. 23 to 25, employs protruding parts 53 and 54 for pushing a local region residing between two convexes 19, on a steel wire 4 at a tip end of a complex stranded wire 2. Therefore, the steel wire 4 at the tip end of the complex stranded wire 2 can be deformed in a large way at an F-type crimp portion 13, thus allowing for a tip end of the steel wire 4 to be sufficiently fixed to the F-type crimp portion 13.

Figure 2:
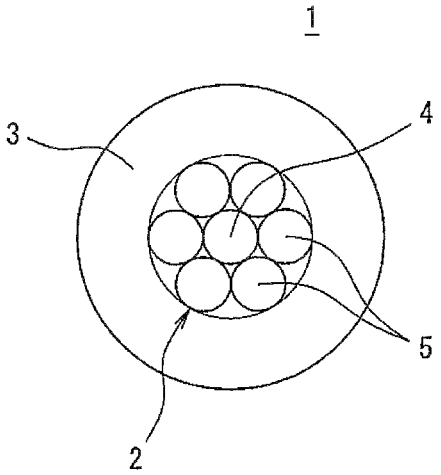
FIG. 2 is a side view of the electric wire shown in FIG. 2.
Figure 3:
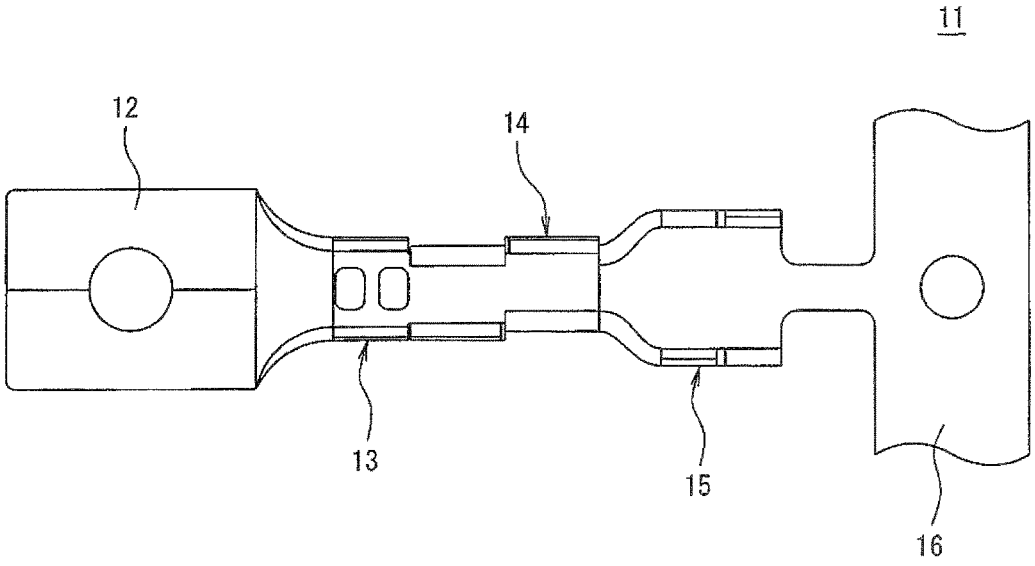
FIG. 3 is a schematic plan view showing a crimp terminal according to an embodiment of this invention.

For observation, prepared was an electric wire with crimp terminal including a crimp terminal 11 shown in FIG. 3, having simply a C-type crimp portion 14 employed to crimp a complex stranded wire 2 of an electric wire 1 shown in FIG. 1. There was an F-type crimp portion 13 unemployed to crimp, leaving barrels as it was released. In this situation, the electric wire with crimp terminal had aluminum element wires 5 protruding out of an opening at barrel tabs of the C-type crimp portion. The electric wire 1 had a set of aluminum element wires 5, and a steel wire 4 of a 0.2 mm diameter. Under this condition, the electric wire with crimp terminal underwent a tensile test, with a result involving aluminum element wires 5 broken at 30 N.

Subsequent thereto, another tensile test was made of an electric wire with crimp terminal including a crimp terminal similar to the crimp terminal 11 shown in FIG. 3 subject to no convex 19 at an F-type crimp portion 13. The crimp terminal was employed to crimp an electric wire 1 including a set of aluminum element wires 5 and a steel wire 4 of a 0.2 mm diameter. There was a result involving aluminum element wires 5 broken at 51 N.

In addition, still another tensile test was made of an electric wire with crimp terminal including a crimp terminal 11 shown in FIG. 3 having an F-type crimp portion 13 provided with convexes 19. This crimp terminal was employed to crimp an electric wire 1 including a set of aluminum element wires 5 and a steel wire 4 of a 0.2 mm diameter. There was a result involving aluminum element wires 5 broken at 55 N.

There have been described embodiments covering situations involving a steel wire 4 as a reinforcement wire, and a set of aluminum element wires as a set of conductor element wires. It however is noted that this invention is applicable to crimp terminals of an open barrel type adapted to fix, by crimping, an electric wire including a complex stranded wire involving a reinforcement wire having a magnitude of strength greater than strengths of conductor element wires. This invention is applicable also to electric wires with crimp terminal employing a crimp terminal for crimping an electric wire including a complex stranded wire involving a reinforcement wire having a magnitude of strength greater than strengths of conductor element wires.

Moreover, embodiments described cover situations involving a crimp terminal 11 having tin-plated brass as a material thereof. It however is noted that the material of crimp terminal can be out of question. Further, embodiments described cover the provision of a combination of a single F-type crimp portion 13 and a single C-type crimp portion 14. However, they may well be a combination of F-type crimp portions and C-type crimp portions. Further, embodiments described cover situations involving a C-type crimp portion 14 having two sets of third and fourth barrel tabs 20 and 21, the two sets of third and fourth barrel tabs 20 and 21 being wound on outer peripheries of a complex stranded wire 2 in different directions. However, they may well be two sets of third and fourth barrel tabs wound on outer peripheries of a complex stranded wire 2 in an identical direction. Further, they may well be a C-type crimp portion provided with one set of third and fourth barrel tabs. In addition, they may well be a C-type crimp portion provided simply with third barrel tabs, without provision of fourth barrel tabs.

Still more, embodiments described assume an electric wire with crimp terminal including an F-type crimp portion 13 having a crimp ratio of 35%. However, they may well be an F-type crimp portion 13 having a crimp ratio of 30% or more. Further, they may well be an electric wire with crimp terminal including a C-type crimp portion having a crimp ratio smaller than a crimp ratio at an F-type crimp portion.

Yet more, embodiments described involve the provision of a pair of convexes 19. However, they may well be provision of one or three convexes 19. Further, embodiments described involve covexes having a height of 0.1 mm. However, they may well be a height of convex equal to or greater than one sixth of a diameter of a complex stranded wire, or equal to or greater than one half of a diameter of a reinforcement wire, whichever is to be set. Further, embodiments described involve a spacing L between convexes 19, as it is set to 0.7 mm. However, they may well be a convex-to-convex spacing set to be equal to or greater than a diameter of a complex stranded wire, or equal to or greater than a diameter of a reinforcement wire times three.

Further, embodiments described involve a set of six aluminum element wires 5 wound on a steel wire 4. It however is noted that this invention is applicable to crimp terminals adapted to crimp an electric wire including a complex stranded wire having a set of conductor element wires wound on an outer periphery of a reinforcement wire, as well as to electric wires with crimp terminal having such an electric wire crimped to fix by using a crimp terminal, subject to the number of conductor element wires that may well be eighteen, for instance. That is, unlike embodiments described having a combination of equalized diameters assigned to a steel wire 4 and aluminum element wires 5, there may well be a combination of unequal diameters. Further, unlike embodiments described including a combination of a steel wire 4 and aluminum element wires 5 each having a diameter set to 0.2 mm, there may well be variations unrestricted thereto.

While embodiments of this invention have been described, it is apparent that some artisan could have made changes without departing from the scope of this invention. It is intended that any and all such modifications and equivalents are involved in the appended claims.

REFERENCE SIGNS LIST

1 . . . electric wire
2 . . . complex stranded wire
4 . . . steel wire
5 . . . aluminum element wire
11 . . . crimp terminal
13 . . . F-type crimp portion
14 . . . C-type crimp portion
17 . . . first barrel tab
18 . . . second barrel tab
19 . . . convex
20 . . . third barrel tab
21 . . . fourth barrel tab
51 to 54 . . . protruding part
P . . . protrusion length

The invention claimed is:

1. A crimp terminal of an open barrel type adapted to fix, by crimping, an electric wire including a complex stranded wire having a set of conductor element wires wound on an outer periphery of a reinforcement wire, the reinforcement wire having a strength greater than strengths of the conductor element wires, the crimp terminal comprising:

an F-type crimp portion comprising a first and a second barrel tab, the first and the second barrel tab being disposed at opposite locations with a longitudinal centerline of the complex stranded wire to be crimped in between, the first and the second barrel tab having an identical length, the F-type crimp portion being configured to have distal ends of the first and the second barrel tab put together to push into a tip end of the complex stranded wire to be crimped; and a C-type crimp portion comprising a third barrel tab adapted to crimp the complex stranded wire, the C-type crimp portion being configured to have the third barrel tab wrapped in a C-form on an outer periphery of the complex stranded wire to be crimped, wherein the F-type crimp portion to be deformed to crimp the tip end of the complex stranded wire comprises a single convex projection provided at a central part thereof in a longitudinal direction of the complex stranded wire, wherein the first barrel tab to be deformed to crimp the tip end of the complex stranded wire comprises a first pair of protruding parts provided at a distal end thereof, wherein the second barrel tab to be deformed to crimp the tip end of the complex stranded wire comprises a second pair of protruding parts provided at a distal end thereof, and wherein the first pair of protruding parts and the second pair of protruding parts are configured for cooperation with the single convex projection to push local regions on the reinforcement wire residing at both sides of the single convex projection at the tip end of the complex stranded wire, to deform the reinforcement wire at the tip end of the complex stranded wire, as the F-type crimp portion is deformed to crimp the tip end of the complex stranded wire.

2. The crimp terminal according to claim 1, wherein the first pair of protruding parts and the second pair of protruding parts have a protrusion length equal to or greater than one third of a diameter of the complex stranded wire.

3. The crimp terminal according to claim 1, wherein the C-type crimp portion comprises a fourth barrel tab configured to crimp the complex stranded wire.

4. A crimp terminal of an open barrel type adapted to fix, by crimping, an electric wire including a complex stranded wire having a set of conductor element wires wound on an outer periphery of a reinforcement wire, the reinforcement wire having a strength greater than strengths of the conductor element wires, the crimp terminal comprising:

an F-type crimp portion comprising a first and a second barrel tab, the first and the second barrel tab being disposed at opposite locations with a longitudinal centerline of the complex stranded wire to be crimped in between, the first and the second barrel tab having an identical length, the F-type crimp portion being configured to have distal ends of the first and the second barrel tab put together to push into a tip end of the complex stranded wire to be crimped; and a C-type crimp portion comprising a third barrel tab adapted to crimp the complex stranded wire, the C-type crimp portion being configured to have the third barrel tab wrapped in a C-form on an outer periphery of the complex stranded wire to be crimped, wherein the F-type crimp portion to be deformed to crimp the tip end of the complex stranded wire comprises a pair of convex projections arrayed in an axial direction of the complex stranded wire, and provided at local parts of the F-type crimp portion for the complex stranded wire to be brought into contact therewith, wherein the first barrel tab to be deformed to crimp the tip end of the complex stranded wire comprises a first protruding part provided at a central part in a longitudinal direction of the complex stranded wire at a distal end of the first barrel tab, wherein the second barrel tab to be deformed to crimp the tip end of the complex stranded wire comprises a second protruding part provided at a central part in a longitudinal direction of the complex stranded wire at a distal end of the second barrel tab, and wherein the first protruding part and the second protruding part are configured for cooperation with the pair of convex projections to push a local region on the reinforcement wire residing between the pair of convex projections at the tip end of the complex stranded wire, to deform the reinforcement wire at the tip end of the complex stranded wire, as the F-type crimp portion is deformed to crimp the tip end of the complex stranded wire.

5. The crimp terminal according to claim 4, wherein the first protruding part and the second protruding part have a protrusion length equal to or greater than one third of a diameter of the complex stranded wire.

6. The crimp terminal according to claim 4, wherein the C-type crimp portion comprises a fourth barrel tab configured to crimp the complex stranded wire.

7. An electric wire with a crimp terminal including a complex stranded wire having a set of conductor element wires wound on an outer periphery of a reinforcement wire, the reinforcement wire having a strength greater than strengths of the conductor element wires, wherein the electric wire is fixed, by crimping, to the crimp terminal that includes an F-type crimp portion and a C-type crimp portion, wherein the F-type crimp portion comprises a first and a second barrel tab, the first and the second barrel tab being disposed at opposite locations with the complex stranded wire in between, the first and the second barrel tab having an identical length, the first and the second barrel tab having distal ends thereof put together and pushed into the complex stranded wire, to crimp a tip end of the complex stranded wire, wherein the C-type crimp portion comprises a third barrel tab, the third barrel tab being wrapped in a C-form on an outer periphery of the complex stranded wire, to crimp the complex stranded wire, wherein the F-type crimp portion to be deformed to crimp the tip end of the complex stranded wire comprises a single convex projection provided at a central part thereof in a longitudinal direction of the complex stranded wire, wherein the first barrel tab to be deformed to crimp the tip end of the complex stranded wire comprises a first pair of protruding parts provided at a distal end thereof, wherein the second barrel tab to be deformed to crimp the tip end of the complex stranded wire comprises a second pair of protruding parts provided at a distal end thereof, and wherein the first pair of protruding parts and the second pair of protruding parts are configured for cooperation with the single convex projection to push local regions on the reinforcement wire residing at both sides of the single convex projection at the tip end of the complex stranded wire, to deform the reinforcement wire at the tip end of the complex stranded wire, as the F-type crimp portion is deformed to crimp the tip end of the complex stranded wire.

8. The electric wire with crimp terminal according to claim 7, wherein the conductor element wires comprise aluminum element wires, and the reinforcement wire comprises a steel wire having an aluminum-plated outer periphery adapted to have suppressed corrosion with the aluminum element wires.

9. An electric wire with a crimp terminal including a complex stranded wire having a set of conductor element wires wound on an outer periphery of a reinforcement wire, the reinforcement wire having a strength greater than strengths of the conductor element wires, wherein the electric wire is fixed, by crimping, to the crimp terminal that includes an F-type crimp portion and a C-type crimp portion, wherein the F-type crimp portion comprises a first and a second barrel tab, the first and the second barrel tab being disposed at opposite locations with the complex stranded wire in between, the first and the second barrel tab having an identical length, the first and the second barrel tab having distal ends thereof put together and pushed into the complex stranded wire, to crimp a tip end of the complex stranded wire, wherein the C-type crimp portion comprises a third barrel tab, the third barrel tab being wrapped in a C-form on an outer periphery of the complex stranded wire, to crimp the complex stranded wire, wherein the F-type crimp portion to be deformed to crimp the tip end of the complex stranded wire comprises a pair of convex projections arrayed in an axial direction of the complex stranded wire, and provided at local parts of the F-type crimp portion for the complex stranded wire to be brought into contact therewith, wherein the first barrel tab to be deformed to crimp the tip end of the complex stranded wire comprises a first protruding part provided at a central part in a longitudinal direction of the complex stranded wire at a distal end of the first barrel tab, wherein the second barrel tab to be deformed to crimp the tip end of the complex stranded wire comprises a second protruding part provided at a central part in a longitudinal direction of the complex stranded wire at a distal end of the second barrel tab, and wherein the first protruding part and the second protruding part are configured for cooperation with the pair of convex projections to push a local region on the reinforcement wire residing between the pair of convex projections at the tip end of the complex stranded wire, to deform the reinforcement wire at the tip end of the complex stranded wire, as the F-type crimp portion is deformed to crimp the tip end of the complex stranded wire.

10. The electric wire with crimp terminal according to claim 9, wherein the conductor element wires comprise aluminum element wires, and the reinforcement wire comprises a steel wire having an aluminum-plated outer periphery adapted to have suppressed corrosion with the aluminum element wires.

11. A crimp terminal of an open barrel type adapted to fix, by crimping, an electric wire including a complex stranded wire having a set of conductor element wires wound on an outer periphery of a reinforcement wire, the reinforcement wire having a strength greater than strengths of the conductor element wires, the crimp terminal comprising:

an F-type crimp portion comprising a first and a second barrel tab, the first and the second barrel tab being disposed at opposite locations with a longitudinal centerline of the complex stranded wire to be crimped in between, the first and the second barrel tab having an identical length, the F-type crimp portion being configured to have distal ends of the first and the second barrel tab put together to push into a tip end of the complex stranded wire to be crimped; and a C-type crimp portion comprising a third barrel tab adapted to crimp the complex stranded wire, the C-type crimp portion being configured to have the third barrel tab wrapped in a C-form on an outer periphery of the complex stranded wire to be crimped, wherein the F-type crimp portion includes at least two convex projections having a spacing therebetween in a longitudinal direction of the complex stranded wire, the spacing configured to be equal to or greater than the diameter of the complex stranded wire, and wherein each convex projection has a height thereof set to be equal to or greater than one sixth of a diameter of the complex stranded wire.

* * * * *